US006142737A

United States Patent [19]

Seeley et al.

[11] Patent Number: 6,142,737

[45] Date of Patent: Nov. 7, 2000

[54] BUCKET AND WHEEL DOVETAIL DESIGN FOR TURBINE ROTORS

[75] Inventors: Robert Ellis Seeley, Broadalbin; Cuong Van Dinh, Schenectady; Eloy Vincent Emeterio, Amsterdam, all of N.Y.

[73] Assignee: General Electric Co., Schenectady, N.Y.

[21] Appl. No.: 09/140,020

[22] Filed: Aug. 26, 1998

[51] Int. Cl.[7] ..... F01D 5/32

[52] U.S. Cl. ..... 416/222; 416/219 R

[58] Field of Search ..... 416/219 R, 220 R, 416/222, 248, 216, 217, 218

[56] References Cited

U.S. PATENT DOCUMENTS

| | | | |
|---|---|---|---|
| 1,353,797 | 9/1920 | Steenstrup | 416/216 |
| 2,753,149 | 7/1956 | Kurti | 416/216 |
| 2,916,257 | 12/1959 | Poellmitz et al. | 416/220 R |
| 4,730,984 | 3/1988 | Ortolano | 416/222 |
| 4,824,328 | 4/1989 | Pisz et al. | 416/248 |
| 5,147,180 | 9/1992 | Johnson | 416/219 R |
| 5,174,720 | 12/1992 | Gradl | 416/222 |
| 5,474,423 | 12/1995 | Seeley et al. . | |
| 5,480,285 | 1/1996 | Patel et al. | 416/248 |
| 5,494,408 | 2/1996 | Seeley et al. | 416/222 |
| 5,531,569 | 7/1996 | Seeley | 416/222 |

FOREIGN PATENT DOCUMENTS

| | | | |
|---|---|---|---|
| 614678 | 12/1948 | United Kingdom | 416/216 |

*Primary Examiner*—Christopher Verdier
*Attorney, Agent, or Firm*—Nixon & Vanderhye

[57] ABSTRACT

A dovetail joint between a rotor wheel and a bucket includes a male dovetail component on the rotor wheel and a female dovetail component in the bucket. The male dovetail component has axially projecting hooks with slanted crush surfaces along generally radially inwardly directed surfaces. The slanted surfaces form included angles with neck portions parallel to a plane normal to the axis of rotation which are larger than 90° and decrease in included angle from the radially outermost hooks to the radially innermost hook where the angle is 90°. Compound fillets are also provided along the transition surfaces between the slanted crush surfaces and the neck surfaces. Thus, stress concentrations are minimized.

12 Claims, 3 Drawing Sheets

BUCKET AND WHEEL DOVETAIL DESIGN FOR TURBINE ROTORS

TECHNICAL FIELD

The present invention relates to turbines and particularly to dovetail joints between the wheel of a steam turbine rotor and steam turbine buckets.

BACKGROUND

Dovetail attachment techniques between turbine buckets and turbine rotor wheels for steam turbines are well known in the art. Conventional tangential entry dovetails on the latter stages of low-pressure rotors operating in a contaminated steam environment have been found to be conducive to stress corrosion cracking (SCC). SCC is accelerated by the stress levels that are present in the hook fillet regions of typical dovetail configurations. Normally, these stresses are acceptable but with contaminated steam, cracks can initiate and, if left undetected, may grow to a depth that will cause failure of the wheel hooks. In extreme cases, all the hooks will fail and buckets will fly loose from the rotor. Long experience with bucket-to-wheel dovetail joints has indicated that the wheel hooks crack but that the bucket hooks do not crack. This is apparently because the NiCrMoV and similar low-alloy steels used for low-pressure rotors are much less resistant to SCC than are the 12Cr steels used for buckets. The steels for the wheels give the optimum combination of properties available for overall low-pressure rotor design considerations. Thus, an effective means of avoiding SCC in the typical low-pressure steam environment is to reduce the stresses in the wheel dovetail to acceptable levels. If the maximum stress in components operating in a corrosive environment is below the yield strength of the material, the resistance to SCC is greatly improved.

One bucket and wheel dovetail design for steam turbine rotors has been described and illustrated in U.S. Pat. No. 5,474,423, of common assignee. In that patent, the dovetail joint design provided four hooks on the rotor wheel which decreased in thickness from the radially outermost hooks to the innermost hooks. Additionally, fillets were provided between neck portions of the rotor wheel dovetails and bottom surfaces of the overlying hooks, with multiple radii, i.e., compound fillets, in order to decrease the stress concentrations with increased radii of the fillets. Additional features of that design included a flat surface along the radially outermost surface of the hook and in combination with various forms of compound fillets. While that dovetail design has been eminently satisfactory, the present dovetail joint provides a configuration which also minimizes concentrated stresses in the wheel hook fillets, while maintaining an overall size compatible with existing steam paths.

DISCLOSURE OF THE INVENTION

In accordance with the present invention, a rotor wheel and bucket dovetail joint design is provided which minimizes concentrated stresses caused by the centrifugal force of the buckets in the wheel hook fillets, while maintaining an overall size compatible with existing steam paths. In accordance with a principal aspect of the present invention, the rotor wheel contact surfaces, i.e., the generally radially inwardly facing surfaces along the undersides of the wheel hooks are provided with slant surface angles for each hook of the dovetail, preferably different slant surface angles at different radii along the dovetail. It will be appreciated that the rotor rotation causes the buckets to develop centrifugal forces which are imposed on the dovetail through the contact surfaces along the undersides of the wheel hooks. These forces give rise to stresses in the dovetail with peak stresses in the fillet regions of the hooks. The slant surfaces reduce the stress concentration for a given fillet radius and permit larger hook fillet radii that further reduces the stress concentration.

More particularly, the crush surfaces for traditional tangential entry dovetails are on an axial-circumferential plane with a fillet used as a transition between the crush surface and the neck surface of the dovetail. These two surfaces are 90° apart in conventional tangential entry dovetails. In the present invention, these crush surfaces, with the exception of the radially innermost hook, are rotated such that the transition angles between the crush surfaces, i.e., slant surfaces, and the neck surfaces (in a radial plane) are greater than 90°. The angles of rotation are called slant angles. Concentrated stresses result when load paths are forced to change direction. With the slanted crush surfaces hereof, the change in direction from 90° to larger angles is less severe and the stress concentration is therefore lower. The slant crush surface also permits a larger fillet radius in the same transition distance as compared to the conventional 90° transition, with a resulting larger fillet radius and lower concentrated stress.

In another aspect of the present invention, it will be appreciated that a slanted crush surface causes a component of force in the axial direction which gives rise to bending of the bucket leg and an axial load on the tang of the wheel dovetail. To minimize this effect, the slant angle is reduced from hook to hook with decreasing radial height and the radially innermost hook preferably has no crush surface slant (i.e., extends parallel to the axis). That is, the larger slant angles are used where the stress concentration is normally higher. Further, because the slant angles of the crush surfaces vary from hook to hook, i.e., increase in angle from radially innermost hooks to radially outermost hooks, the fillet radii are increased to that extent and stress concentrations thereby reduced.

In a further aspect of the present invention, and as noted previously, peak stress decreases as the size of the hook fillet radius increases. To maximize this effect in a minimal transition distance, compound fillets are employed in radially innermost hooks, for example, the two radially innermost hooks of a four-hook dovetail array. These fillets are designed such that the large radius spans the region of peak stress and the small radius completes the transition in a minimum distance. Optimally, this effect may be achieved by continuously varying the radii to maximize the curvature in the region of peak stress.

In a further aspect, it will be appreciated that hook thickness controls the load sharing between hooks, as well as the bending and shear stresses on hooks. Consequently, the hook thickness is varied to achieve uniform and minimum concentrated stresses, i.e., hook thickness increases with decreasing radial height.

While the invention as described herein relates to a four-hook dovetail, the present invention can be employed and applied to dovetails with any number of hooks. Additionally, the invention is not limited to rotors susceptible to SCC and the benefits and advantages hereof can be realized for other stress-causing conditions which initiate cracking in dovetail hooks such as dovetail cracking in high-temperature regions when creep is the failure mode rather than SCC.

In a preferred embodiment according to the present invention, there is provided a dovetail joint between a rotor wheel and a bucket rotatable about an axis, comprising a male dovetail component on the rotor wheel and a female dovetail component in the bucket, the male dovetail component receiving the female dovetail component in a direction tangential to the rotor wheel, the male dovetail component including a plurality of hooks lying on opposite sides of a plane normal to the axis with each hook having a generally radially inwardly facing surface, the surfaces of at least certain of the hooks on opposite sides of the plane lying at angles extending away from the plane and away from the axis.

In a further preferred embodiment according to the present invention, there is provided a dovetail joint between a rotor wheel and a bucket rotatable about an axis, comprising a male dovetail component on the rotor wheel and a female dovetail component in the bucket, the male dovetail component receiving the female dovetail component in a direction tangential to the rotor wheel, the male dovetail component including a plurality of hooks, at least certain of the hooks having generally radially inwardly facing surfaces lying at angles extending away from the axis and the male dovetail component, the angle of the surfaces of certain hooks relative to the axis decreasing from the radially outermost hooks of certain hooks toward the radially innermost hooks thereof.

Accordingly, it is a primary object of the present invention to provide a rotor wheel and bucket dovetail joint which minimizes concentrated stresses caused by centrifugal force of the buckets in the wheel hook fillets while maintaining an overall size compatible with existing hot gas paths in the turbines.

BEST MODE FOR CARRYING OUT THE INVENTION

Figure 1:
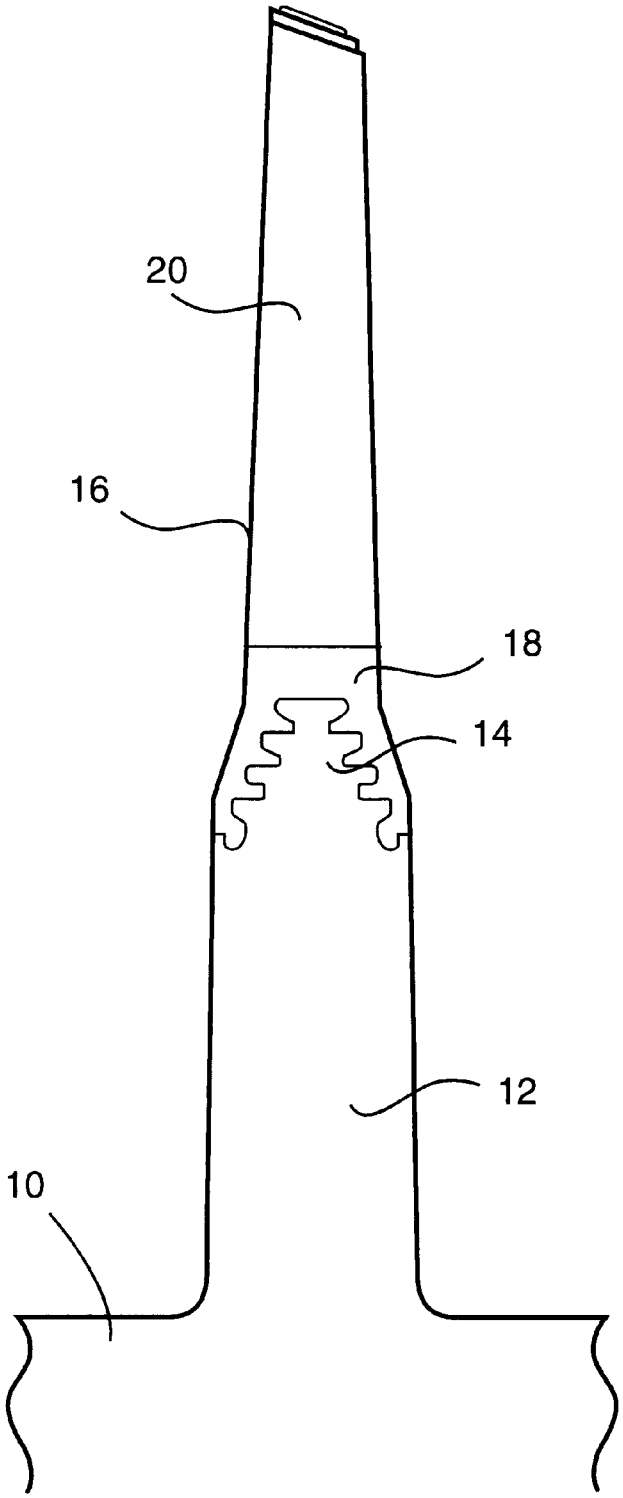
Fig. 1 (Prior Art)
FIG. 1 is a schematic representation of a typical turbine rotor wheel and bucket dovetail joint.

Referring to FIG. 1, there is illustrated a rotor body, for example, a shaft 10, mounting a rotor wheel 12, terminating along its outer radius in a series of male dovetail components 14. The turbine buckets 16 each include a female dovetail joint 18 along its radial innermost portion for mating with the male dovetail joint 14, the bucket 16 including a blade 20 extending from the female dovetail component 18. As will be appreciated, the dovetail joint is a tangential entry-type dovetail arrangement.

Figure 2:
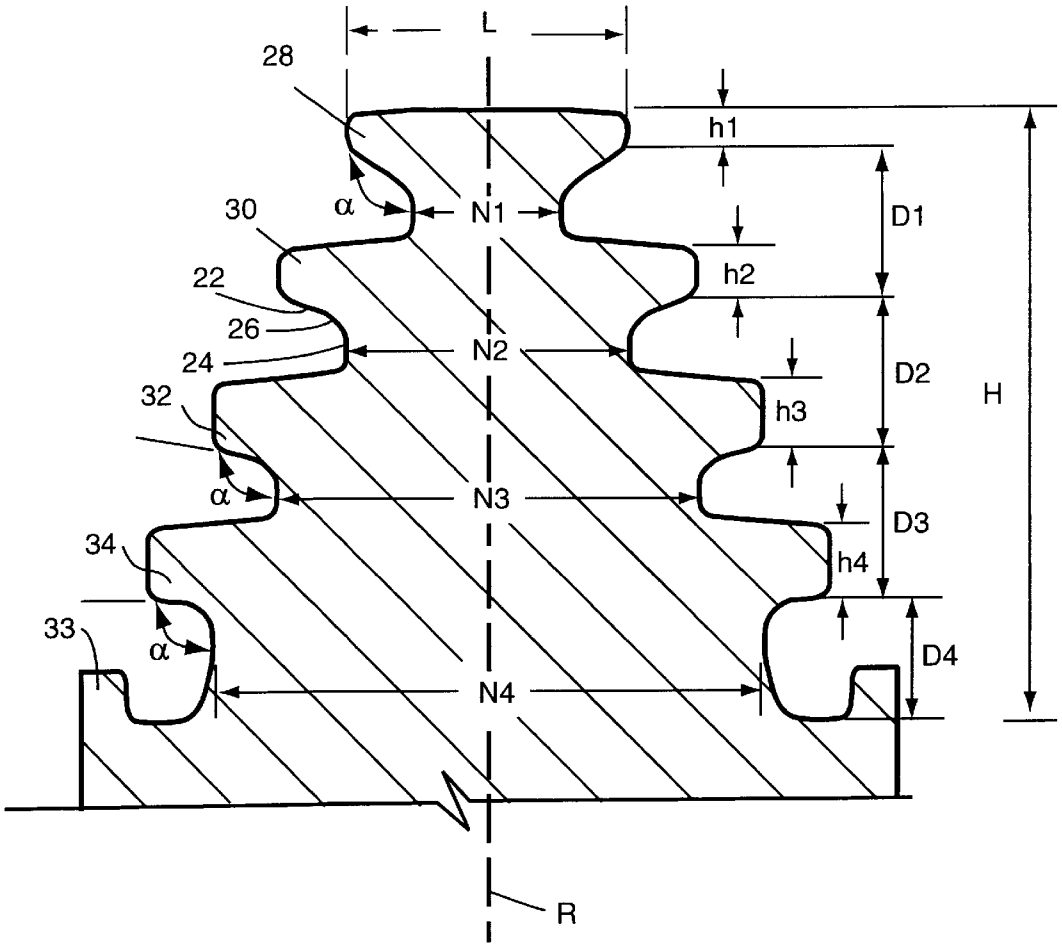
FIG. 2 is a cross-sectional view of a turbine wheel dovetail in accordance with the present invention.
Figure 5:
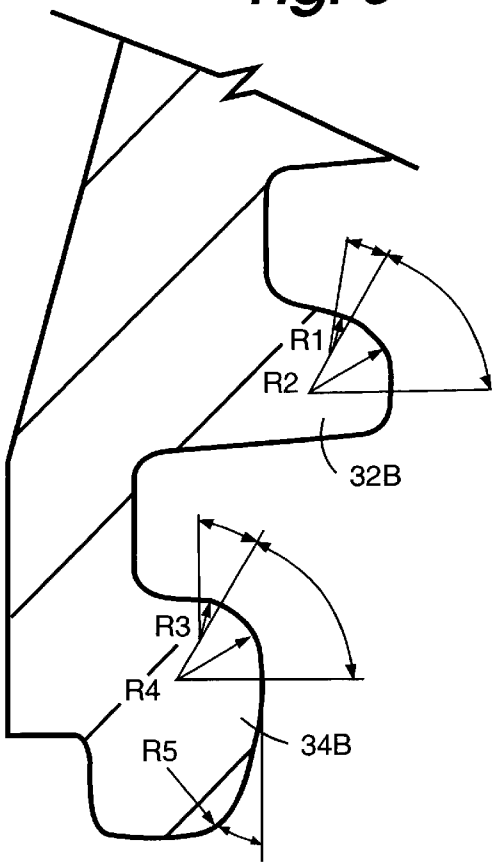
FIG. 5 is a fragmentary enlarged cross-sectional view of the radial innermost hooks of the bucket dovetail joint.

In the ensuing description, it will be appreciated that the dovetails are symmetric in a radial plane normal to the axis of rotation of shaft 10 and that it is accepted practice to refer only to half the dovetail, i.e., the dovetail hooks along one side of the radial plane. Thus, the present description refers to four hooks forming the dovetail, even though there are actually eight hooks on the dovetail joint. In conventional practice, the hooks are referred to sequentially as first, second, third and fourth hooks from the radially outermost hook to the radially innermost hook. Further, the contact surfaces between the wheel hooks and the bucket hooks are known as crush surfaces. The crush surface for tangential entry dovetails lies on an axial circumferential plane with a fillet employed as a transition between the crush surface and the neck surface of the dovetail. As illustrated in FIG. 2, crush surfaces 22, neck surfaces 24 and fillets 26 between those surfaces are provided each of the hooks 28, 30, 32 and 34 of the wheel dovetail joint.

As will be appreciated from a review of FIG. 2, the slanted crush surfaces 22 of each of the hooks forms an angle $\alpha$ with the neck portion 24, which is a radially extending portion. For example, the surface 22 of hook 28 forms an included angle $\alpha$ of 120° with the neck portion 24. The slanted surface 22 of hook 30 forms an included angle $\alpha$ of 110° with neck portion 24, radially underlying hook 30. Slanted surface 22 of hook 32 forms an included angle $\alpha$ of 100° with the underlying neck portion 24. The surface 22 of hook 34 forms an angle $\alpha$ of 90° with the neck portion 24 underlying hook 34. Thus, it will be appreciated that the slanted crush surfaces 22 decrease in slant angle relative to the radial underlying neck portion with decreasing radius. Concentrated stresses result when load paths are forced to change direction. Slanted crush surfaces cause a less severe change in direction and hence afford lower stress concentrations. Thus, the change in direction of the slanted crush surfaces relative to the neck portions increases with increasing radial distance, thereby lowering stress concentrations with increasing radius. Stated differently, for a given applied force to each of the hooks 28, 30, 32 and 34, the stress concentration is lower with increasing radial distance.

It will also be appreciated that with a slanted crush surface along the radial undersides of the hooks, larger fillet radii in the same transition distances are provided as compared with a 90° transition between such crush surfaces and neck portions. This larger fillet radius results in a further lower concentrated stress. As noted previously, slanted crush surfaces cause a component of force in the axial direction which gives rise to the bending of the bucket leg and an axial load on the tang 33 of the wheel dovetail. To minimize this effect, the slanted crush surfaces 22 are reduced from hook to hook in a radially inward direction, with the crush surfaces of the last hook, i.e., hook 34 lying parallel to the axis without a slant. This is acceptable because the larger slant angles are used where the concentrated stresses are normally higher.

Figure 3:
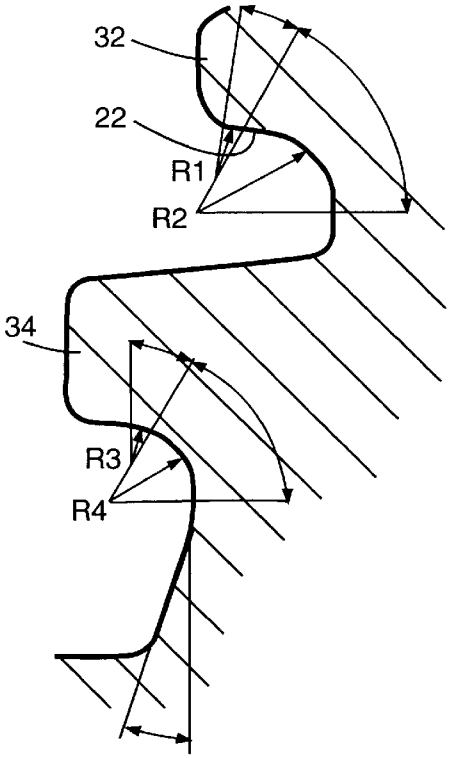
FIG. 3 is an enlarged fragmentary cross-sectional view of the compound fillets of the third and fourth hooks of the dovetail joint of the rotor wheel.

As noted previously, the peak stress decreases as the size of the hook fillet radius increases. To maximize this effect in a minimal transition distance, compound fillets are employed in certain hooks, preferably the radially innermost hooks 32 and 34. For example, with reference to FIG. 3, the slant surfaces 22, transition surfaces 26 and neck surface portions 24 for the third and fourth hooks of the preferred embodiment hereof are illustrated. With respect to hook 32, the transition surface is defined by a compound fillet, with two separate radii. In a clockwise direction from the vertical, a first radius R1 of 0.167 inches extends through an arc of 20° and a second radius R2 of 0.304 inches extends through a radius of 60° from the radius R1, the 60° angle terminating along a radius parallel to the axis of rotation. The compound fillet underlying the fourth hook 34 as illustrated in FIG. 3 is formed of two radii. For example, a first radii R3 of 0.150 inches extends approximately 30°. A second radius R4 extends 0.300 inches over 60°. The termination of the radius R4 extends parallel to the axis of rotation.

Turning back to FIG. 2, it will be seen that the top surfaces of each of the hooks 28, 30, 32 and 34 are also slanted in a direction away from the radial plane R normal to the axis of rotation and toward the axis. Preferably, the slant angle is approximately 5°. It will also be appreciated from a review of FIG. 2 that the hook thickness is varied as between the various hooks. The hook thickness controls the load sharing between the hooks, as well as the bending and shear stress in the hooks. The hook thickness is varied to achieve uniform and minimized concentrated stresses. Accordingly, the hook thickness increases with decreasing radial distance.

Other significant dimensions relating to the disclosed exemplary embodiment are as follows:

| | Hook Axial Length L | Hook Radial Height |
|---|---|---|
| Hook 1 (28) | 1.880 inches | .331 inches (h1) |
| Hook 2 (30) | 2.780 inches | .334 inches (h2) |
| Hook 3 (32) | 3.680 inches | .463 inches (h3) |
| Hook 4 (34) | 4.580 inches | .500 inches (h4) |

The hook radial height h extends from the axially outermost end of each top surface of a hook to the beginning of the slant surface along its underside as indicated by h1–h4 in FIG. 2. The radial distances D1–D4 between the slant surfaces measured from the juncture of each slant surface and the axially outermost tip of the hooks to a like location of adjacent hooks are as follows: D1=1.010 inches; D2=1.063 inches; D3=1.032 inches; and D4=0.814 inches.

The neck axial length N is as follows:

N1—between hooks 28 and 30—0.980 inches

N2—between hooks 2 (30) and 3 (32)—1.880 inches

N3—between hooks 3 (32) and 4 (34)—2.780 inches

N4—between hook 4 (34) and the tang—3.680 inches.

The fillet radii for wheel dovetail hooks 28 and 30 are 0.300 and 0.275 inches, respectively.

Figure 4:
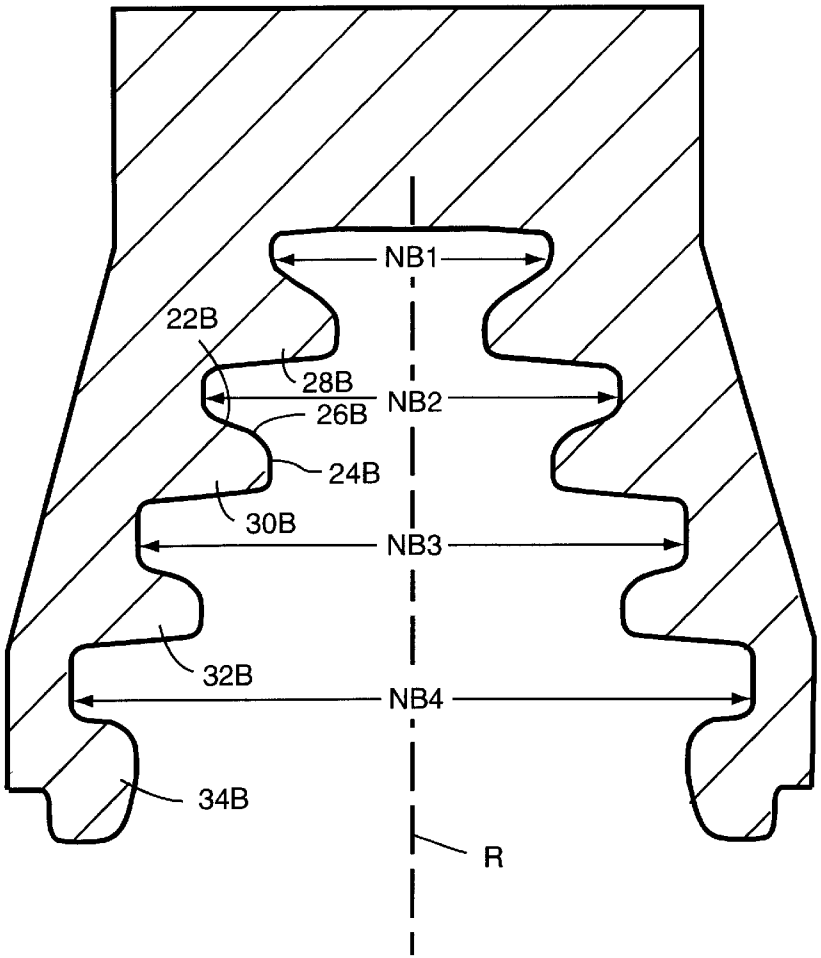
FIG. 4 is a cross-sectional view of a bucket dovetail joint for mating with the dovetail joint of the wheel dovetail of FIG. 2.

Referring to FIG. 4, the female dovetail component of the bucket is illustrated and is generally complementary to the male dovetail component illustrated in FIG. 2. The various complementary components of the bucket dovetail are assigned like reference numerals as the wheel dovetail, followed by the suffix "B." Except for the tolerances, the dimensional characteristics of the bucket dovetail are the same as the dimensional characteristics for the wheel dovetail. For example:

Dovetail height of the bucket is 4.197 inches.

The axial length between hooks are as follows:

Hook 1 (28B)—1.000 inches

Hook 2 (30B)—1.900 inches

Hook 3 (32B)—2.800 inches

Hook 4 (34B)—3.700 inches.

The neck axial lengths NB are as follows.

NB1—above hook 28B—1.900 inches

NB2—above hook 30B—2.800 inches

NB3—above hook 32B—3.700 inches

NB4—above hook 34B—4.600 inches.

The complementary radii for the bucket hooks 32B and 34B complementary to the radii R1–R4 of the wheel hooks in inches are as follows:

| | R1 | Angle | R2 | Angle | R3 | Angle | R4 | Angle |
|---|---|---|---|---|---|---|---|---|
| Wheel Hooks | .167 | 20° | .304 | 60° | .150 | 30° | .300 | 60° |
| Bucket Hooks | .157 | 20° | .294 | 60° | .140 | 30° | .290 | 60° |

With the foregoing dimensions, it will be appreciated that the dovetail shape minimizes concentrated stresses, while maintaining an overall size compatible with existing steam paths. Key features of the design provides for wheel contact surfaces that slant at different angles for each hook to reduce the stress concentration for each hook. This also reduces the stress concentration for a given fillet radius and enables larger hook fillet radii that further reduce stress concentrations.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A dovetail joint between a rotor wheel and a bucket rotatable about an axis, comprising:

a male dovetail component on the rotor wheel and a female dovetail component in the bucket, said male dovetail component receiving said female dovetail component in a direction tangential to the rotor wheel, said male dovetail component including a plurality of hooks lying on opposite sides of a plane normal to the axis and bisecting said male dovetail component, each said hook having a generally radially inwardly facing surface;

said surfaces of at least a pair of said hooks on each of the opposite sides of the plane lying at angles extending away from said plane and away from said axis, the angles of said surfaces of said radial outermost hooks of said pairs of hooks being greater relative to the axis than the angles of said surfaces of radial innermost hooks of said pairs thereof.

2. A joint according to claim 1 wherein said surfaces of radially innermost hooks of said plurality of hooks extend generally parallel to said axis.

3. A joint according to claim 1 wherein neck portions join said surfaces and generally radially outwardly facing portions of radially inwardly underlying hooks, and fillets between said neck portions and said surfaces.

4. A joint according to claim 3 wherein the fillet between a neck portion and an inwardly facing surface of a hook on each side of said plane decreases in radius in a direction toward said surface.

5. A joint according to claim 3 wherein said fillet between a neck portion and an inwardly facing surface of a hook on each side of said plane comprises first and second radiussed surfaces, said first radiussed surface lying between said angled surface and said second radiussed surface and said second radiussed surface lying between said first radiussed surface and said neck portion, said first radiussed surface having a smaller radius than said second radiussed surface.

6. A joint according to claim 3 wherein the fillet between a neck portion and an inwardly facing surface of a hook on each side of said plane decreases in radius in a direction toward said inwardly facing surface, said fillet on each opposite side of said plane underlying at least one of said pair of hooks on a corresponding side of said plane.

7. A joint according to claim 1 wherein each hook from a radially outermost hook to a radially innermost hook increases in radial thickness.

8. A dovetail joint between a rotor wheel and a bucket rotatable about an axis, comprising:

a male dovetail component on the rotor wheel and a female dovetail component in the bucket, said male dovetail component receiving said female dovetail component in a direction tangential to the rotor wheel, said male dovetail component including a plurality of hooks lying on opposite sides of a plane normal to the axis and bisecting said male dovetail component, each said hook having a generally radially inwardly facing surface and a generally radially outwardly facing surface, each hook from a radially outermost hook to a radially innermost hook increasing in radial thickness between said radially inwardly facing and radially outwardly facing surfaces.

9. A joint according to claim 8 wherein said radially inwardly facing surfaces of the radially innermost hooks extend generally parallel to said axis, the radially inwardly facing surfaces of hooks radially outwardly of said innermost hooks extending at angles away from said axis and said male dovetail component.

10. A joint according to claim 8 wherein neck portions join said radially inwardly facing surfaces and generally radially outwardly facing portions of radially inwardly underlying hooks, and fillets between said neck portions and said radially inwardly facing surfaces.

11. A joint according to claim 10 wherein the fillet between a neck portion and a radially inwardly facing surface of a hook on each side of said male dovetail component decreases in radius in a direction toward said radially inwardly facing surface.

12. A joint according to claim 10 wherein said fillet between a neck portion and a radially inwardly facing surface of a hook on each side of said male dovetail component comprises first and second radiussed surfaces, said first radiussed surface lying between said angled surface and said second radiussed surface and said second radiussed surface lying between said first radiussed surface and said neck portion, said first radiussed surface having a smaller radius than said second radiussed surface.

* * * * *